US008770994B1

(12) United States Patent
Fagan et al.

(10) Patent No.: US 8,770,994 B1
(45) Date of Patent: Jul. 8, 2014

(54) CHILD RESISTANT SAFETY PLUG ACCESSORY

(71) Applicants: Brett Fagan, Monroe Township, NJ (US); Thomas Avallone, Monroe Township, NJ (US)

(72) Inventors: Brett Fagan, Monroe Township, NJ (US); Thomas Avallone, Monroe Township, NJ (US)

( * ) Notice: Subject to any disclaimer, the term of this patent is extended or adjusted under 35 U.S.C. 154(b) by 43 days.

(21) Appl. No.: 13/626,043

(22) Filed: Sep. 25, 2012

(51) Int. Cl.
*H01R 13/44* (2006.01)

(52) U.S. Cl.
USPC ..... 439/141

(58) Field of Classification Search
USPC ..... 439/141, 140
See application file for complete search history.

(56) References Cited

U.S. PATENT DOCUMENTS 3,513,435 A 5/1970 Degaetano
3,575,684 A 4/1971 McIntyre
3,631,320 A 12/1971 Eckert
4,445,739 A 5/1984 Wooten
D326,642 S 6/1992 Lowe
5,252,082 A 10/1993 Hsieh et al.
5,423,689 A * 6/1995 Valentino ..... 439/141
5,518,411 A 5/1996 Belleci
7,011,535 B2 * 3/2006 Dickie ..... 439/141
7,094,080 B2 * 8/2006 Dickie et al. ..... 439/141

* cited by examiner

*Primary Examiner* — Gary Paumen
(74) *Attorney, Agent, or Firm* — Kyle A. Fletcher, Esq.

(57) ABSTRACT

The child resistant safety plug accessory fits onto an existing male prong plug in order to insulate and protect the male prongs from producing an electrical arc with auxiliary objects when being inserted, removed, or used to transmit electricity from a female pronged plug or electrical outlet. The child resistant safety plug accessory is comprised of an interfacing member that is defined with an inner surface and an outer surface, and slots that correspond with the various prongs of the male-pronged plug. The inner surface abuts against a plug wall whereas collapsible prong members extend outwardly from the outer surface in order to encompass the various prongs of the male-pronged plug when un-inserted into an electrical outlet or female electrical plug. The collapsible prong members are biased outwardly, and collapse when pressed against an external surface of the electrical outlet or female electrical plug.

18 Claims, 5 Drawing Sheets

CHILD RESISTANT SAFETY PLUG ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of child-proofing products, more specifically, a safety plug that prevents access to the electrical prongs of a male electrical plug when fully or partially inserted into an electrical outlet or female plug.

Small children are constantly on the go, and often times are highly curious. This is part of the developmental process, but can be dangerous where access is available to electrical plugs and electrical outlets. There have been numerous attempts to improve the safety of electrical outlets, electrical plugs, and connections therewith. There are products that cover the electrical outlets on the wall in order to prevent a child from inserting small objects therein. There have been or are products that ensure a secure connection of a male electrical plug to a wall outlet. However, no attempt has been made to protect the space that may exist between where male prongs connect with a female plug or an electrical outlet.

The device of the present application seeks to address the need of concerned parents by providing a device that prevents access to the space between where a male plug inserts the male prongs into the female slots of an electrical outlet or a female plug.

B. Discussion of the Prior Art

As a preliminary note, it should be stated that there is an ample amount of prior art that deals with child protection against electrical outlet and plugs, generally. As will be discussed immediately below, no prior art discloses a child resistant safety plug accessory that fits onto an existing male prong plug in order to insulate and protect the male prongs from producing an electrical arc with auxiliary objects when being inserted, removed, or used to transmit electricity from a female pronged plug or electrical outlet; wherein the child resistant safety plug accessory is comprised of an interfacing member that is defined with an inner surface and an outer surface whereby the inner surface abuts against a plug wall; wherein the interfacing member includes slots that align and correspond with the various prongs of a male pronged plug such that the interfacing member slides over the various prongs of the male pronged plug; wherein collapsible prong members extend outwardly from the outer surface in order to encompass the various prongs of the male pronged plug when un-inserted into an electrical outlet or female electrical plug; wherein the collapsible prong members are biased outwardly, and collapse when pressed against an external surface of the electrical outlet or female electrical plug, and which thereby covers any gaps that would otherwise be exposed during insertion, removal, or in use of electrical transmission with respect of the male pronged plug.

The Eckert Patent (U.S. Pat. No. 3,631,320) discloses an electrical plug that has a retractable sheath over the prongs, which retracts when the plug is inserted into the outlet. However, the retractable sheet is integrated into the construction of a male pronged plug, and is not an accessory that is specifically designed for use with an existing male pronged plug, and which is able to secure itself thereon.

The Hsieh et al. Patent (U.S. Pat. No. 5,252,082) discloses a safety plug with a spring loaded cover over the prongs that automatically retracts as the plug comes in contact with the outlet. Again, the safety plug is integrated into the design of the male pronged plug, and is not an accessory that is configured for use with an existing male pronged plug.

The Wooten Patent (U.S. Pat. No. 4,445,739) discloses a male electrical plug with a retractable prong cover in which the plastic sheath slides into the plug body when the plug is inserted into the outlet. Again, the retractable prong cover is not part of an accessory that is installed on an existing male pronged plug, and which protects the prongs during insertion, removal, or connection with an electrical outlet.

The Degaetano Patent (U.S. Pat. No. 3,513,435) discloses a safety electrical plug in which the prongs are cover with a retractable plastic sheath that retracts upon entry into the outlet. Again. The safety electrical plug includes the sheaths in the construction of the safety electrical plug, and is not an accessory that can attach onto and secures itself to an existing male pronged plug.

The Belleci Patent (U.S. Pat. No. 5,518,411) discloses an electrical plug with a retractable prong shield. Again. The electrical plug includes the shield in the construction of the electrical plug, and is not an accessory that can attach onto and secures itself to an existing male pronged plug.

The McIntyre Patent (U.S. Pat. No. 3,575,684) discloses an electrical plug having an insulating sheath that is spring-biased to a position cover the prongs of the plug and which retracts, baring the prongs, as it is inserted into an electrical outlet. Again. The electrical plug includes the sheaths in the construction of the electrical plug, and is not an accessory that can attach onto and secures itself to an existing male pronged plug.

While the above-described devices fulfill their respective and particular objects and requirements, they do not describe a child resistant safety plug accessory that fits onto an existing male prong plug in order to insulate and protect the male prongs from producing an electrical arc with auxiliary objects when being inserted, removed, or used to transmit electricity from a female pronged plug or electrical outlet; wherein the child resistant safety plug accessory is comprised of an interfacing member that is defined with an inner surface and an outer surface whereby the inner surface abuts against a plug wall; wherein the interfacing member includes slots that align and correspond with the various prongs of a male pronged plug such that the interfacing member slides over the various prongs of the male pronged plug; wherein collapsible prong members extend outwardly from the outer surface in order to encompass the various prongs of the male pronged plug when un-inserted into an electrical outlet or female electrical plug; wherein the collapsible prong members are biased outwardly, and collapse when pressed against an external surface of the electrical outlet or female electrical plug, and which thereby covers any gaps that would otherwise be exposed during insertion, removal, or in use of electrical transmission with respect of the male pronged plug. In this regard, the child resistant safety plug accessory departs from the conventional concepts and designs of the prior art.

SUMMARY OF THE INVENTION

The child resistant safety plug accessory fits onto an existing male prong plug in order to insulate and protect the male prongs from producing an electrical arc with auxiliary objects when being inserted, removed, or used to transmit electricity from a female pronged plug or electrical outlet. The child resistant safety plug accessory is comprised of an interfacing member that is defined with an inner surface and an outer surface, and slots that correspond with the various prongs of the male-pronged plug. The inner surface abuts against a plug wall whereas collapsible prong members extend outwardly from the outer surface in order to encompass the various prongs of the male-pronged plug when un-inserted into an electrical outlet or female electrical plug. The collapsible prong members are biased outwardly, and collapse when pressed against an external surface of the electrical outlet or female electrical plug, and which thereby covers any gaps that would otherwise be exposed during insertion, removal, or in use of electrical transmission with respect of the male-pronged plug.

It is an object of the invention to provide an accessory that is specifically adapted to attach onto an existing male-pronged plug, and which covers the prongs during use, insertion, or removal in order to prevent arcing with auxiliary objects, and which produces a child-proofing or safety measure.

A further object of the invention is to provide an interfacing member of thin profile, which slides over the prongs of the male-pronged member in order to rigidly secure itself to the male-pronged plug.

An even further object of the invention is to include collapsible prong members on an outer surface of the interfacing member, which collapse when contacted against a surface.

An even further object of the invention is for the collapsible prong members to extend as the male-prong plug is being removed from the electrical wall outlet or female-pronged plug.

Another object of the invention is to include a strap that extends from the interfacing member, and which works with a zip tie in order to secure the accessory to the male-pronged plug.

Another object of the invention is to include a cut line that travels across the interfacing member, and in between the earth ground prong and the two circuit prongs in order to adapt the accessory for use with either a two-pronged or three-pronged plug.

These together with additional objects, features and advantages of the child resistant safety plug accessory will be readily apparent to those of ordinary skill in the art upon reading the following detailed description of presently preferred, but nonetheless illustrative, embodiments of the child resistant safety plug accessory when taken in conjunction with the accompanying drawings.

In this respect, before explaining the current embodiments of the child resistant safety plug accessory in detail, it is to be understood that the child resistant safety plug accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the child resistant safety plug accessory.

It is therefore important that the claims be regarded as including such equivalent construction insofar as they do not depart from the spirit and scope of the child resistant safety plug accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
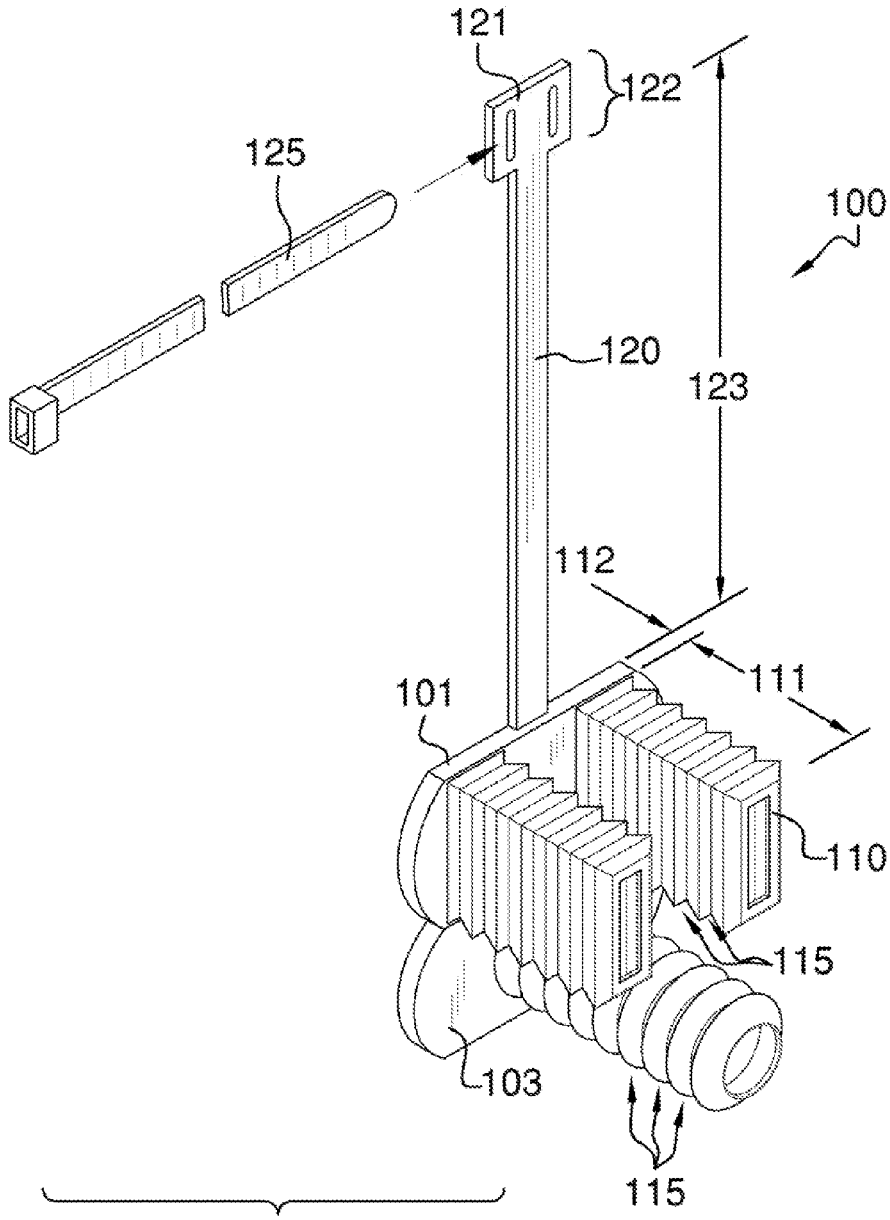
FIG. 1 illustrates a perspective view of the child resistant safety plug accessory by itself and depicting the collapsible prong members fully extended outwardly with respect to the outer surfaces of the interfacing member, and along with detail as the zip tie and the strap.
Figure 2:
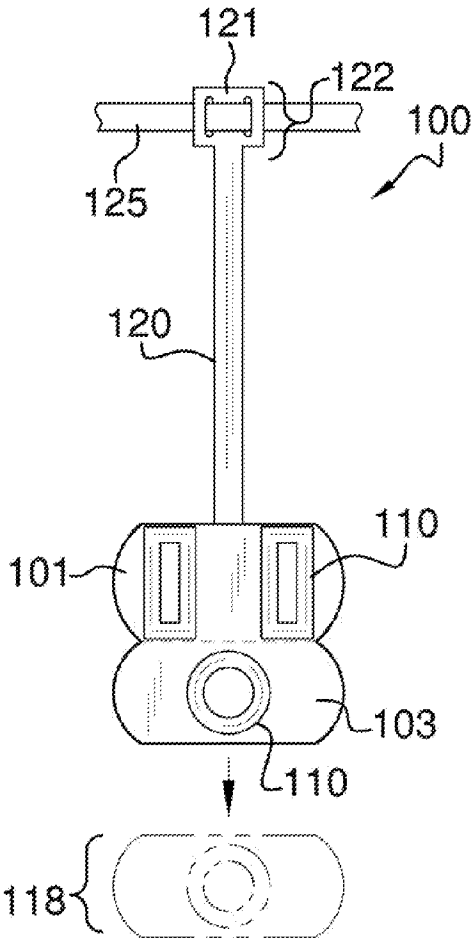
FIG. 2 illustrates a front view of the child resistant safety plug accessory wherein the interfacing member has been broken along the cut line to remove an earth ground portion.
Figure 3:
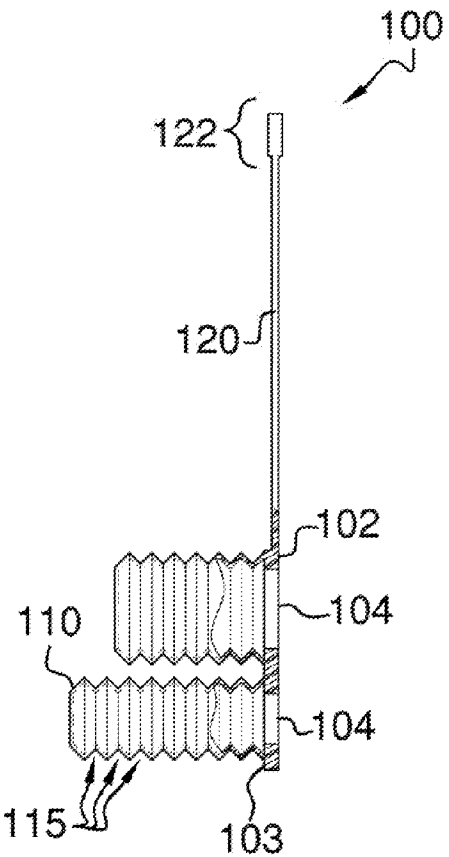
FIG. 3 illustrates a side view of the collapsible prong members.
Figure 4:
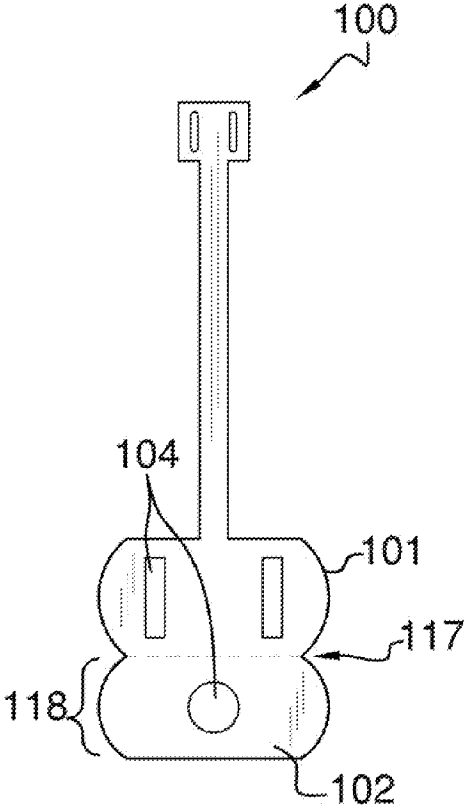
FIG. 4 illustrates a rear view of the child resistant safety plug accessory wherein the slots on the interfacing member are more visible.
Figure 5:
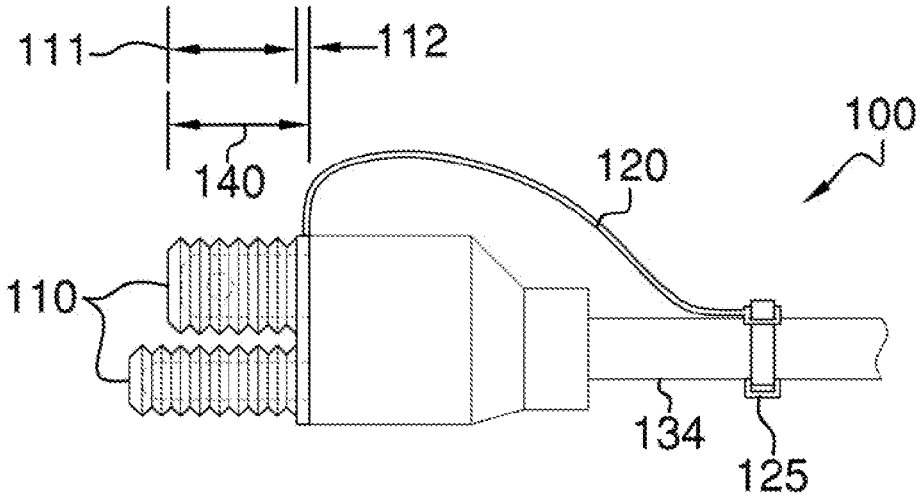
FIG. 5 illustrates a side view of the child resistant safety plug accessory installed on a three-pronged male plug and depicting the collapsible prong members fully extended.
Figure 6:
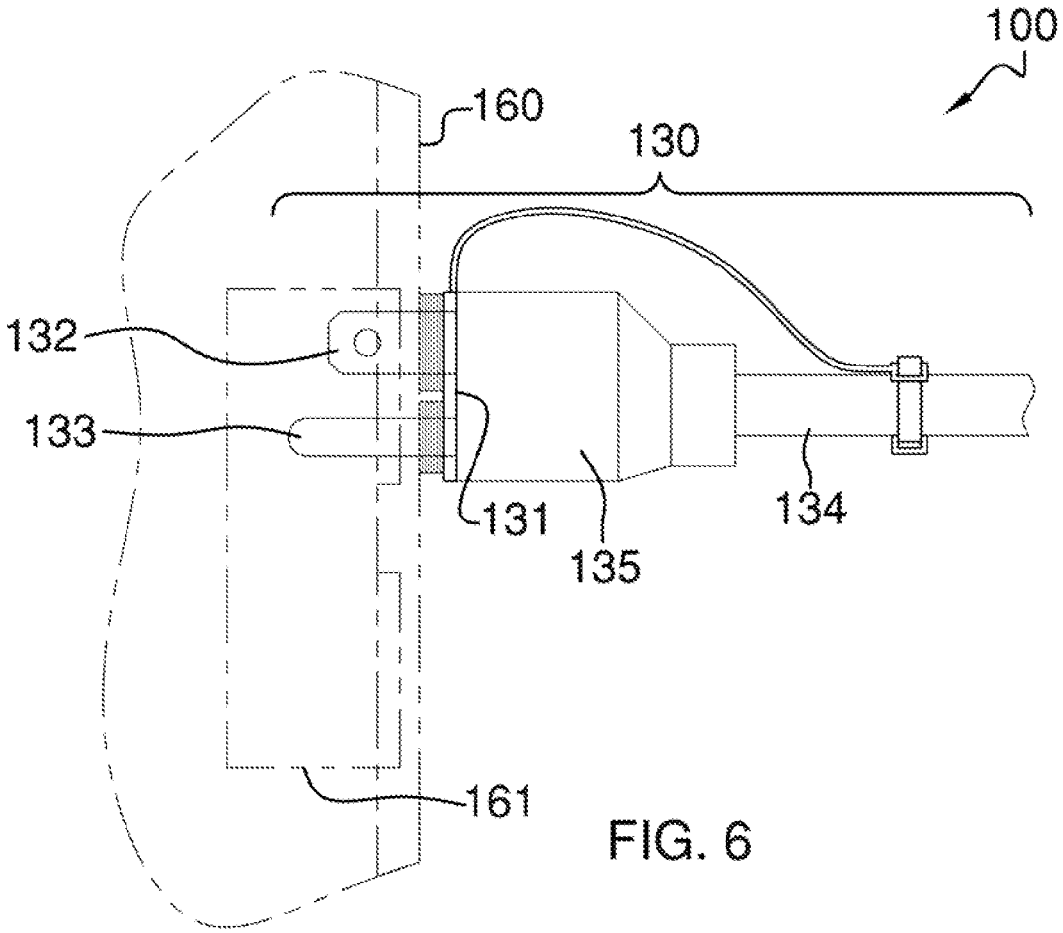
FIG. 6 illustrates a side view of the child resistant safety plug accessory fully inserted into an electrical outlet.

Detailed reference will now be made to the preferred embodiment of the present invention, examples of which are illustrated in FIGS. 1-6. A child resistant safety plug accessory 100 (hereinafter invention) includes an interfacing member 101 that is further defined with art inner surface 102 and an outer surface 103. The interfacing member 101 has a thin profile, and is made of a non-conductive material such as a plastic. The interfacing member 101 has a shape that shall provide coverage to a plug wall 131 of a male-pronged plug 130.

As a preliminary matter it shall be duly noted that the male-pronged plug 130 is further defined as including at least the positive electrical prong 132, the negative electrical, prong 132, and may include an earth ground prong 133. Moreover, the male-pronged plug 130 includes a cord 134, which extends from a male-pronged plug housing 135. It shall be further noted that the invention 100 is adapted for use with either a two-pronged or three-pronged version of the male-pronged plug 130, and will be discussed further below.

The interfacing member 101 includes prong slots 104, which correspond and align with the prongs of the male-pronged plug 130 such that the interfacing member 101 slides down the prongs to abut the inner surface 102 against the plug wall 131. The outer surface 103 includes collapsible prong members 110 that extend outwardly from the outer surface 103. The collapsible prong members 110 are of hollowed construction, and are made of non-conductive materials such as a rubber or plastic. The collapsible prong members 110 have a length 111, which when added with a profile width 112 of the interfacing member 101 shall be equal to or longer than a prong length 140.

Figure 7:
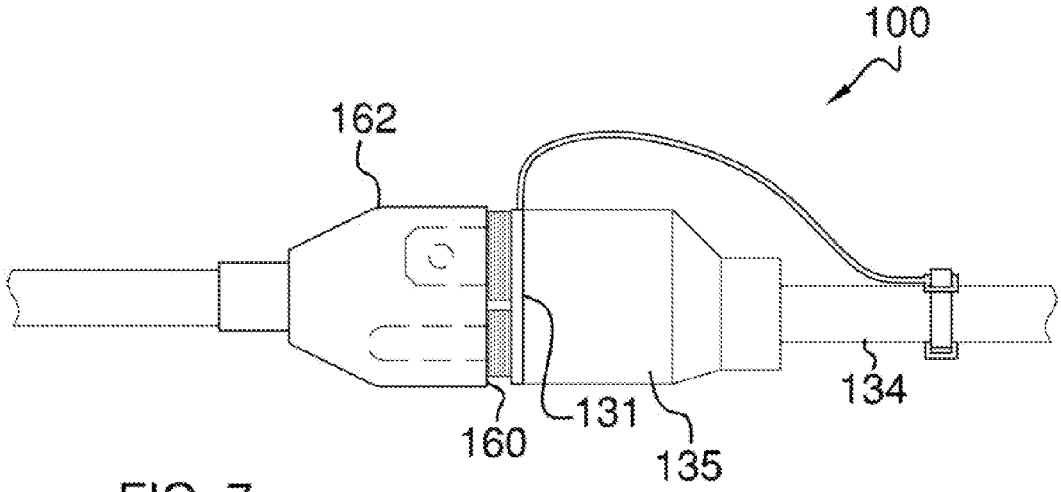
FIG. 7 illustrates a side view of the child resistant safety plug accessory fully inserted into a female plug.
Figure 8:
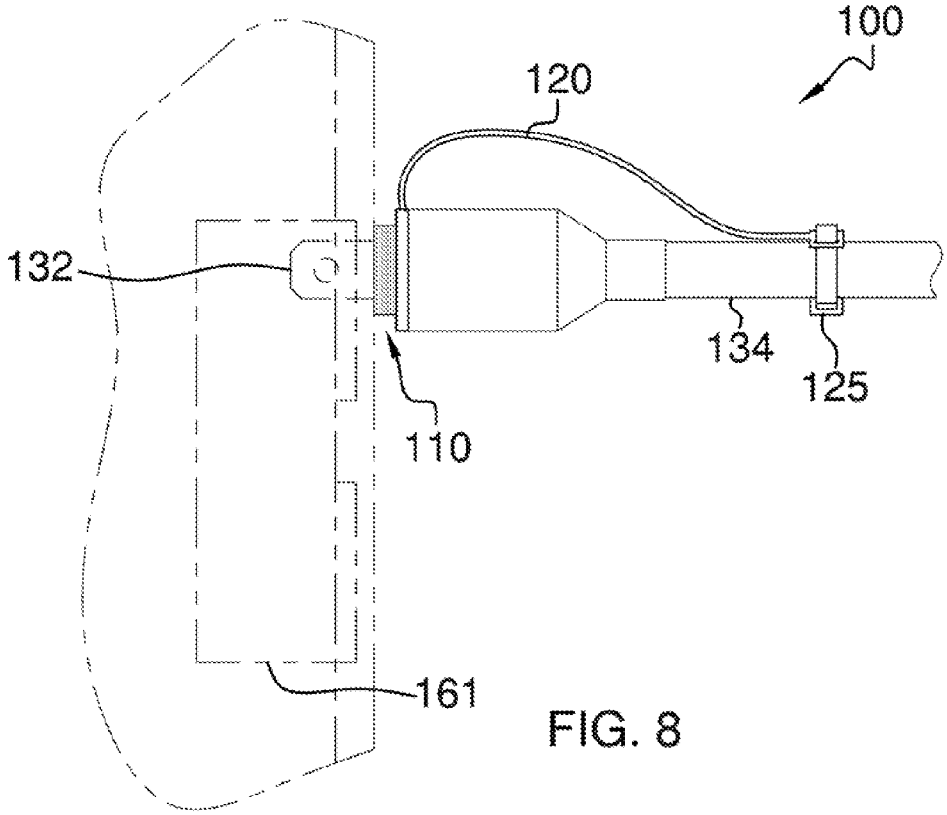
FIG. 8 illustrates a side view of a two-pronged male plug fully inserted into an electrical outlet.
Figure 9:
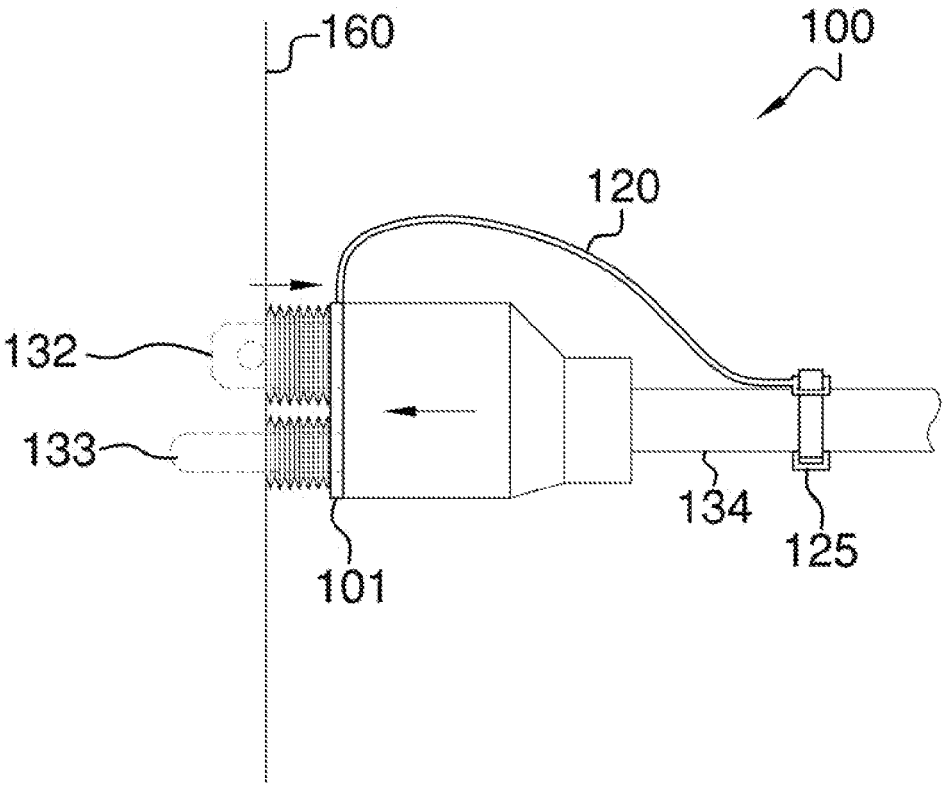
FIG. 9 illustrates a side view of the child resistant safety plug accessory during insertion into the electrical outlet in order to depict retraction of the collapsible prong members.

The collapsible prong members 110 are biased outwardly due to the construction of the collapsible prong members 110 as well as the materials used therein. Moreover, the collapsible prong members 110 include corrugations 115 along the length 111, which enables the extension of or retraction of the collapsible prong members 110. The collapsible prong members 110 retract when impacting a wall surface 160 during insertion of the male-pronged plug 130 into either an electrical outlet 161 or a female-pronged plug 162. Referring to FIGS. 5-9, the invention 100 is designed to work with either a 2- pronged or 3-pronged male plug 130 in order to bridge a gap formed between the several prongs and the electrical outlet 161 or female pronged plug 162 during insertion, removal, or during use therein.

The interfacing member 101 also includes a cut line 117, which enables an earth prong portion 118 to be several from the interfacing member 101. The severing of the earth prong portion 118 will enable the invention 100 to be adapted for use with a 2-pronged male plug 130, (see FIGS. 2 and 8).

The interfacing member 101 also includes a strap 120 that extends from the interfacing member 101 upwardly to a distal end 121 wherein a tie-strap slots 122 are provided. The strap 120 is of an undefined length 123, and is made of a flexible material such that the strap 120 is bent backwardly in order for a zip-tie 125 to secure the distal end 121 of the strap 120 to the electrical cord 134 of the male-pronged plug 130. The strap 120 and the zip-tie 125 are included with the invention 100 in order to better secure the interfacing member 101 to the plug wall 131 of the male-pronged plug 130, and also to prevent unintended removal of the invention from the male-plug 130 all together.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those stilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A child resistant safety plug accessory comprising:

an interfacing member with slots provided thereon, which is adapted for sliding onto electrical prongs of a male-pronged plug;

wherein collapsible prong members extend outwardly in order to cover the electrical prongs;

wherein the collapsible prong members are biased outwardly, and extend and retract when touching a wall surface of an electrical outlet or female-pronged plug;

wherein the interfacing member includes a cut line, which enables an earth prong portion to be severed from the interfacing member in order for the accessory to be configured for use with a 2-pronged male plug as opposed to a 3-pronged male plug;

wherein the interfacing member includes a strap that extends from the interfacing member upwardly to a distal end wherein tie-strap slots are provided, and enable a zip-tie to secure the strap to an electrical cord that is associated with the male-pronged plug.

2. The child resistant safety plug accessory as described in claim 1 wherein the interfacing member is further defined with an inner surface and an outer surface; wherein the interfacing member has a thin profile, and is made of a non-conductive material.

3. The child resistant safety plug accessory as described in claim 2 wherein the collapsible prong members extend outwardly from the outer surface; wherein the collapsible prong members are of hollowed construction, and are made of non-conductive materials.

4. The child resistant safety plug accessory as described in claim 3 wherein the collapsible prong members each have a length, which when added with a profile width of the interfacing member is be equal to or longer than a prong length.

5. The child resistant safety plug accessory as described in claim 4 wherein the collapsible prong members are biased outwardly, and include a plurality of corrugations along the length, which facilitates the extension of or retraction of the collapsible prong members with respect to the electrical prongs of the male-pronged plug.

6. The child resistant safety plug accessory as described in claim 1 wherein the strap is of an undefined length, and is made of a flexible material such that the strap is bent backwardly in order for the zip-tie to secure the distal end of the strap to the electrical cord of the male-pronged plug.

7. A child resistant safety plug accessory comprising:

an interfacing member with slots provided thereon, which is adapted for sliding onto electrical prongs of a male-pronged plug;

wherein collapsible prong members extend outwardly in order to cover the electrical prongs;

wherein the collapsible prong members are biased outwardly, and extend and retract when touching a wall surface of an electrical outlet or female-pronged plug;

wherein the interfacing member is further defined with an inner surface and an outer surface; wherein the interfacing member has a thin profile, and is made of a non-conductive material;

wherein the interfacing member includes a strap that extends from the interfacing member upwardly to a distal end wherein tie-strap slots are provided, and enable a zip-tie to secure the strap to an electrical cord that is associated with the male-pronged plug.

8. The child resistant safety plug accessory as described in claim 7 wherein the collapsible prong members extend outwardly from the outer surface; wherein the collapsible prong members are of hollowed construction, and are made of non-conductive materials.

9. The child resistant safety plug accessory as described in claim 8 wherein the collapsible prong members each have a length, which when added with a profile width of the interfacing member is be equal to or longer than a prong length.

10. The child resistant safety plug accessory as described in claim 9 wherein the collapsible prong members are biased outwardly, and include a plurality of corrugations along the length, which facilitates the extension of or retraction of the collapsible prong members with respect to the electrical prongs of the male-pronged plug.

11. The child resistant safety plug accessory as described in claim 10 wherein the interfacing member includes a cut line, which enables an earth prong portion to be severed from the interfacing member in order for the accessory to be configured for use with a 2-pronged male plug as opposed to a 3-pronged male plug.

12. The child resistant safety plug accessory as described in claim 7 wherein the strap is of an undefined length, and is made of a flexible material such that the strap is bent backwardly in order for the zip-tie to secure the distal end of the strap to the electrical cord of the male-pronged plug.

13. A child resistant safety plug accessory comprising:

an interfacing member with slots provided thereon, which is adapted for sliding onto electrical prongs of a male-pronged plug;

wherein collapsible prong members extend outwardly in order to cover the electrical prongs;

wherein the collapsible prong members are biased outwardly, and extend and retract when touching a wall surface of an electrical outlet or female-pronged plug;

wherein the interfacing member is further defined with an inner surface and an outer surface; wherein the interfacing member has a thin profile, and is made of a non-conductive material;

wherein the interfacing member includes a cut line, which enables an earth prong portion to be severed from the interfacing member in order for the accessory to be configured for use with a 2-pronged male plug as opposed to a 3-pronged male plug.

14. The child resistant safety plug accessory as described in claim 13 wherein the collapsible prong members extend outwardly from the outer surface; wherein the collapsible prong members are of hollowed construction, and are made of non-conductive materials.

15. The child resistant safety plug accessory as described in claim 14 wherein the collapsible prong members each have a length, which when added with a profile width of the interfacing member is be equal to or longer than a prong length.

16. The child resistant safety plug accessory as described in claim 15 wherein the collapsible prong members are biased outwardly, and include a plurality of corrugations along the length, which facilitates the extension of or retraction of the collapsible prong members with respect to the electrical prongs of the male-pronged plug.

17. The child resistant safety plug accessory as described in claim 13 wherein the interfacing member includes a strap that extends from the interfacing member upwardly to a distal end wherein tie-strap slots are provided, and enable a zip-tie to secure the strap to an electrical cord that is associated with the male-pronged plug.

18. The child resistant safety plug accessory as described in claim 17 wherein the strap is of an undefined length, and is made of a flexible material such that the strap is bent backwardly in order for the zip-tie to secure the distal end of the strap to the electrical cord of the male-pronged plug.

* * * * *